United States Patent [19]

Kubo et al.

[11] Patent Number: 5,063,133

[45] Date of Patent: Nov. 5, 1991

[54] ELECTROPHOTOGRAPHIC DEVELOPING SYSTEM COMPRISING TONER HAVING SPECIFIC PARTICLE SIZE DISTRIBUTION

[75] Inventors: Tsutomu Kubo; Kazuo Terao; Takashi Yamamuro; Masashi Kajimoto; Kazuhiko Tsukagoshi, all of Kanagawa, Japan

[73] Assignee: Fuji Xerox Co., Ltd., Tokyo, Japan

[21] Appl. No.: 659,471

[22] Filed: Feb. 25, 1991

Related U.S. Application Data

[63] Continuation of Ser. No. 270,448, Nov. 7, 1988, abandoned, which is a continuation of Ser. No. 925,373, Oct. 31, 1986, abandoned.

[30] Foreign Application Priority Data

Oct. 31, 1985 [JP] Japan ..... 60-242916

[51] Int. Cl.[5] ..... G03G 13/09

[52] U.S. Cl. ..... 430/122; 430/903; 430/111

[58] Field of Search ..... 430/122, 903, 111

[56] References Cited

U.S. PATENT DOCUMENTS 4,108,786 8/1978 Takayama ..... 430/903
4,122,024 10/1978 Jones et al. ..... 430/111
4,284,701 8/1981 Abbott et al. ..... 430/111
4,543,312 9/1985 Murakawa et al. ..... 430/903

FOREIGN PATENT DOCUMENTS

53975/85 3/1985 Japan .

*Primary Examiner*—David Welsh
*Attorney, Agent, or Firm*—Finnegan, Henderson, Farabow, Garrett and Dunner

[57] ABSTRACT

A developing system for an electrostatic image reproduction machine comprising a mono-component developer having toner particles of selected diameters dispersed therein; container for holding the developer; a developer sleeve for receiving a quantity of the developer from the container; a restriction member for forming a thin layer of the developer on the sleeve; a device for impacting an electric charge to the developer layer; and a latent image retainer for selectively receiving the electrically charged layer for forming a visible image. The developer satisfies the expression $d_{75}/d_{25} \leqq d_{50}/40+1.2$ where $d_{25}$, $d_{50}$ and $d_{75}$ represent diameters of toner particles when the percentage by volume or by weight of toner particles of that diameter as compared to the total volume or weight of the developer is 25%, 50% and 75%, respectively. A developer and method for making the developer are also described.

10 Claims, 2 Drawing Sheets

ELECTROPHOTOGRAPHIC DEVELOPING SYSTEM COMPRISING TONER HAVING SPECIFIC PARTICLE SIZE DISTRIBUTION

This application is a continuation of application Ser. No. 07/270,448, filed Nov. 7, 1988, now abandoned which is a continuation of application Ser. No. 07/925,373, filed Oct. 31, 1986, now abandoned.

BACKGROUND OF THE INVENTION

The present invention relates generally to developing systems for electrostatic latent images. More particularly, the present invention relates to a developing system in which mono or one-component a developer supplied onto a developer sleeve is formed into a developer layer having a predetermined thickness and a predetermined amount of electric charge by a restriction member, and the developer layer is transferred to an electrostatic latent image to make the latent image visible.

In the area of dry-type developing systems for developing electrostatic latent images formed on electrostatic latent image retainers, a binary or two-component developing system has been developed and put into practical use which uses a two-component developer containing toner particles and carrier particles. The toner particles are charged by triboelectrification with the carrier particles, so that the charged toner particles are electrostatically attracted to an electrostatic latent image. This developing system has proven satisfactory in practical use. However, recently a one-component developing method and system, which uses a one-component developer containing only toner particles, has been proposed to avoid problems in deterioration of the developer.

Such a one-component developing system may be classified into two types, one using a magnetic developer and the other using a nonmagnetic developer. In addition, a mono component system may develop the image by direct contact between the developer and the electrostatic latent image, or without any such direct contact.

An example of the one-component developing system is disclosed in Japanese Patent Unexamined Publication No. 53975/85 published on Mar. 28, 1985. This example is shown in FIG. 1, herein. In the drawing, the reference numeral 1 designates an electrostatic latent image retainer which retains on its surface an electrostatic latent image 2 with a surface potential of 200 to 900 V. A developer sleeve 4 is made of phenol, including carbon, glass fiber, and the like, and has a thickness of 1 mm, a specific resistance of $1\times10^{10}\Omega$cm and a relative dielectric constant $\epsilon=30$. This sleeve 4 is disposed on a developer electrode 3 in opposition to the surface of the electrostatic latent image retainer 1 at a distance of about 100 to 400 μm. The surface of the developer sleeve 4 is polished in the axial direction (that is, in the direction perpendicular to the direction of carrying a developer) with sandpaper or the like so as to provide a surface roughness (Rz: average roughness in 10 measurements in accordance with the Japanese Industrial Standard) of about 1 to 10 μm.

A supply member with a depth of about 1 mm for supplying a developer 5, reserved in a hopper 10, onto the developer sleeve 4 is urged against the developer sleeve 4 so as to rotate in the direction of the arrow in the drawing at the same peripheral velocity as that of the developer sleeve 4. In order to reduce the load exerted on the developer sleeve 4 when the supply member 6 is urged against the sleeve 4, a shaft 8 is used as the supply member 6. A foamer 9 of urethane or the like is wound around the shaft 8 and the shaft is further covered with EPDM rubber (ethylene propylene rubber) or the like in a thickness of 0.5 to 1 mm. On the surface of the rubber, convexities or projection are distributed equidistantly at 15°with a height of about 200 m, to thereby transfer the developer 5 between the convexities onto the developer sleeve 4. The thus transferred developer 5 is transported to a restriction member 7 by the rotation (in the direction of arrow in the drawing) of the developer sleeve 4, and is electrically charged by triboelectrification. The charged developer 5 is formed into a uniform layer (0.3 to 1.0 mg/cm$^2$) on the developer sleeve 4, so as to be transferred onto the electrostatic latent image 2.

The restriction member 7 comprises a 0.1 mm thick spring material of SUS304 CSP3/4H, and a 1 mm thick silicone rubber material of rubber hardness 50°, the silicone rubber material containing an additive filler of silicone dioxide and titanium dioxide. The contact pressure between the restriction member 7 and the developer sleeve 4 is set to a value within a range from 50 to 300 g/cm.

A high-frequency alternating voltage having a frequency of 1-10 KHz and Vpp of 400–4500 V, on which a DC voltage of 200–400 V is superimposed, is impressed on the developing electrode 3 to form a peripheral electric field at the electrostatic latent image portion 2 on the electrostatic latent image retainer 1, to thereby move the developer 5 and cause development.

The developer 5 is a nonmagnetic one-component developer having a particle diameter of 5–20 μm. It is prepared by dispersing a pigment, such as carbon black or the like, and a polarity control material, such as a metal-including dye or the like, in various kinds of thermoplastic resins, such as a styrene resin, an acrylic resin, etc., and grinding and classifying the same. When occasion demands, hydrophobic silica may be added to the developer 5 in an amount within a range of from 0.1 to 2.0% by weight per amount of the particles of the developer 5, in order to improve movability of the developer 5 from the developer sleeve 4 onto the electrostatic latent image 2.

In the conventional one-component developing method as described above, uniformity of the layer of the developer 5 after passing through the restriction member 7 has a large influence on picture quality. In other words, when a uniform layer of the developer 5 is prepared, it is possible to obtain a distinct picture having a uniform and dark image in the solid region and no fog in the background region. On the contrary when the layer of the developer 5 is not uniform, only a poor picture which has an ill-balanced and light image in the solid part and fog in the background region is obtained.

In the prior art, the layer of the developer 5 has been uniform on some occasions, but it also has been ill-balanced and non-uniform at other times. Accordingly, a uniform layer of the developer 5 could not be prepared consistently so that only a poor picture having an ill-balanced and light image in the solid region and fog in the background region has been obtained.

Accordingly, it is an object of the present invention is to solve the problems in the above-mentioned developing system, or in other words to provide a consistently uniform developer layer on a developer sleeve so as to provide a copy having a uniformly clear image in the solid region and no fog in the background region.

Additional objects and advantages impact will be obvious from the description, and in part may be learned by practice of the invention.

SUMMARY OF THE INVENTION

To achieve the foregoing objects and in accordance with the principles of the invention, as embodied and broadly described herein, the developing system of the present invention comprises a mono-component developer having toner particles of selected diameters dispersed therein; container means for holding the developer; developer sleeve means for receiving a quantity of the developer from the container means; restriction member means for forming a thin layer of the developer on the carrier means; means for imparting an electric charge to the developer layer; and latent image retaining means for selectively receiving the electrically charged layer for forming a visible image. The developer satisfies the expression $d_{75}/d_{75} \leqq d_{50}/40+1.2$ where $d_{25}$, d50 and $d_{75}$ represent diameters of toner particles when the percentage by volume or by weight of toner (developer) particles of that diameter as compared to the total volume or weight of the developer is 25%, 50% and 75%, respectively. The diameters of toner particles are measured by Coulter counter (Electrical Sensing-Zone Method). The developer may be magnetic or non-magnetic.

Preferably, the restriction member means includes a spring member having a covering containing rubber. It is also preferred that vanadium pentoxide be included on the spring member.

The developer may include a pigment and a polarity control material dispersed in a thermoplastic resin. For example, the pigment may include carbon black and the polarity control material may include auriferous dye. Alternatively, the pigment may include phthalocyanine blue pigment and the polarity control material may include quaternary ammonium salt. If desired, the developer may include carbon black and magnetite dispersed in a styrene-acrylic resin.

The invention also includes a developer and method of making a developer as set forth herein.

BRIEF DESCRIPTION OF THE DRAWINGS

The accompanying drawings, which are incorporated in and constitute a part of this specification, illustrate one embodiment of the invention and, together with the description, serve to explain the principles of the invention.

Of the drawings.

DETAILED DESCRIPTION OF THE PREFERRED EMBODIMENT

Reference will now be made in detail to the present preferred embodiment of the invention, examples of which are described below. In accordance with the invention, the developing system for an electrostatic image reproduction machine comprises a mono-component developer having toner particles of selected diameters dispersed therein; container means for holding the developer; developer sleeve means for receiving a quantity of the developer from the container means; restriction member means for forming a thin layer of the developer on the carrier means; means for impacting an electric charge to the developer layer; and latent image retaining means for selectively receiving the electrically charged layer for forming a visible image. According to the invention, the developer satisfies the expression $d_{75}/d_{25} \leqq d_{50}/40+1.2$ where $d_{25}$, $d_{50}$ and $d_{75}$ represent diameters of toner (developer) particles when the percentage by volume or by weight of toner (developer) particles of that diameter as compared to the total volume or weight of the developer is 25%, 50% and 75%, respectively. Preferably, the developer particles are integrated in order of increasing diameter.

Figure 2:
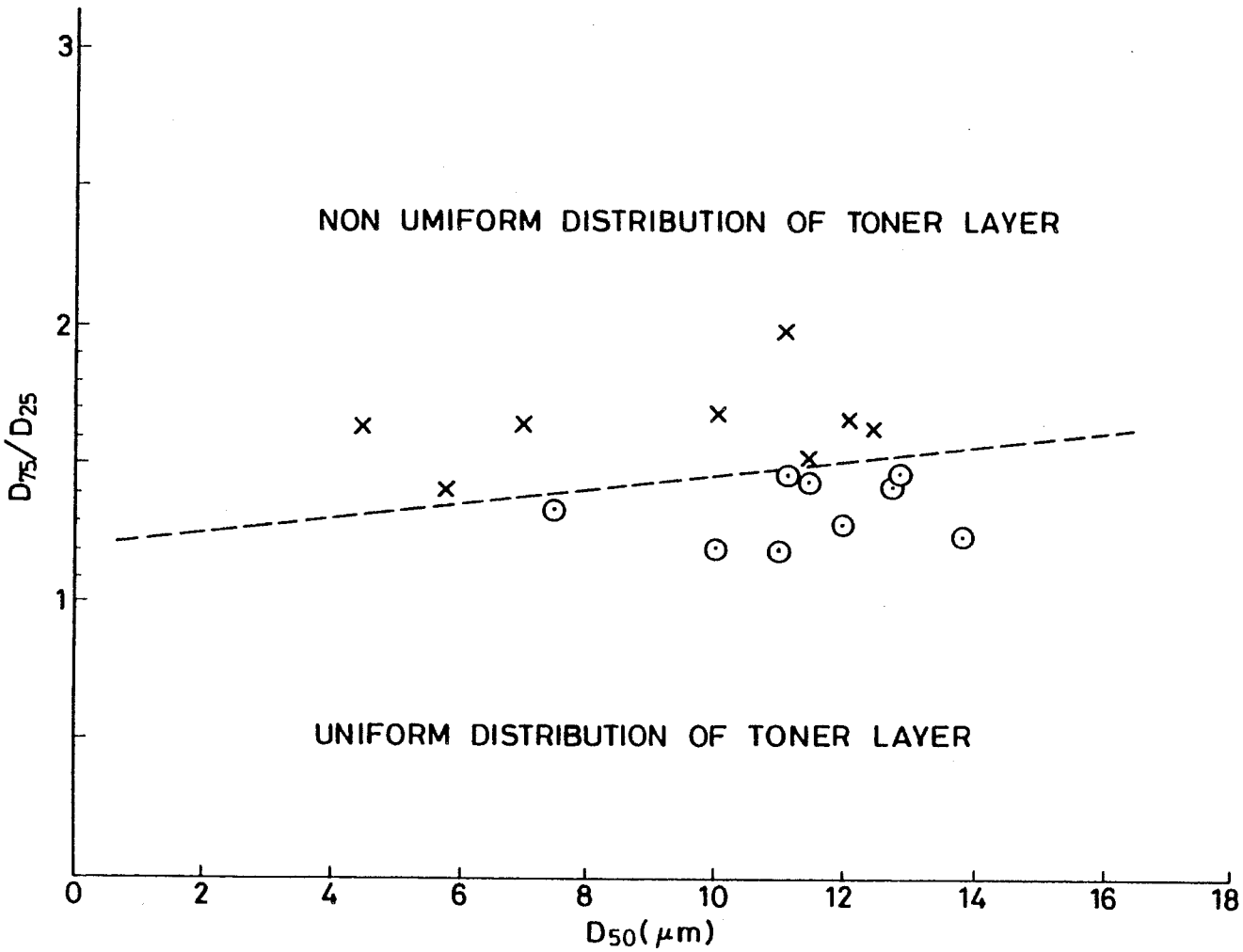
FIG. 2 is a graph showing the relationship between the distribution of toner particles by particle diameter and the distribution of the developer layer on a developer sleeve.

FIG. 2 is a graph showing the results of observations on the uniformity of the developer layer on the developer sleeve after being restricted by the restriction member to permit use of developers having a variety of particle diameter distributions.

The respective cases where the developer layer was uniform (o) and not-uniform (x) were plotted on a coordinate system with $d_{50}$ as the abscissa and $d_{75}/d_{25}$ as the ordinate. The results show that the two cases have a correlation to each other, and the correlation is represented by a straight line: $d_{75}/d_{25} = d_{50}/40+1.2$. That is, the graph shows that uniform toner layers were formed in the area under the straight line.

The present invention will be more fully described with reference to the following examples.

EXAMPLE 1

Figure 1:
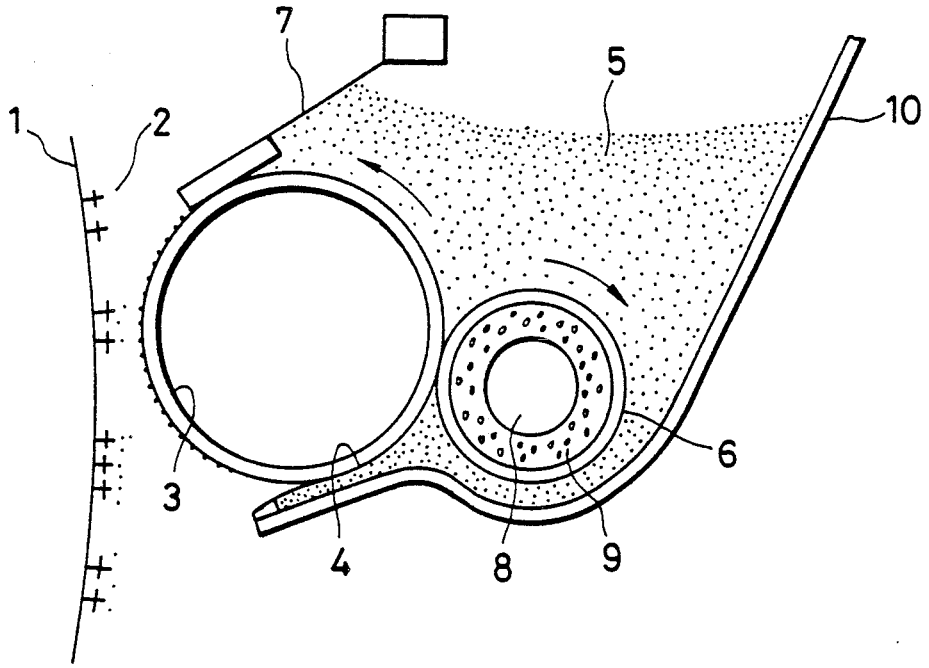
FIG. 1 is a schematic diagram of an example of a nonmagnetic one-component developing system.

A test was conducted by preparing a developer containing 8 parts by weight of carbon black and 2 parts by weight of auriferous dye in a styrene-acrylic resin which satisfied the equations $d_{75}/d_{25}=1.2$ and $d_{50}=10$ μm). This developer was introduced into a developing system, such as that shown in FIG. 1 in which the diameter of the developer sleeve 4 was selected to be 20 mm. As a result of the test, a uniform layer of the developer was obtained and a good quality copy picture was achieved.

As a comparative example, a developer of the same compound described above, but satisfying the equations $d_{75}/d_{25}=1.7$ and $d_{50}=10(\mu m)$, was tested in the same developing system. In this test, the layer of the developer was not uniform, and satisfactory copies could not be obtained.

EXAMPLE 2

Another test was carried out with a developer containing 4 parts by weight of phthalocyanine blue pigment and 1 part by weight of quarternary ammonium salts in a styrene-acrylic resin. The developer satisfied the equations $d_{75}/d_{25}=1.3$ and $d_{50}=12(\mu m)$. This developer was introduced into a developing system such as that shown in FIG. 1. The diameter of the developer sleeve 4 was selected to be 15 mm and the restriction member included an SUS spring material and a silicone rubber material. About 1% by weight of vanadium pentoxide was disposed on the SUS spring member. An electrostatic latent image was charged to a range of from −150 to 800V. A uniform layer of the developer 5 could be obtained, and a good blue copy picture was achieved.

EXAMPLE 3

Figure 3:
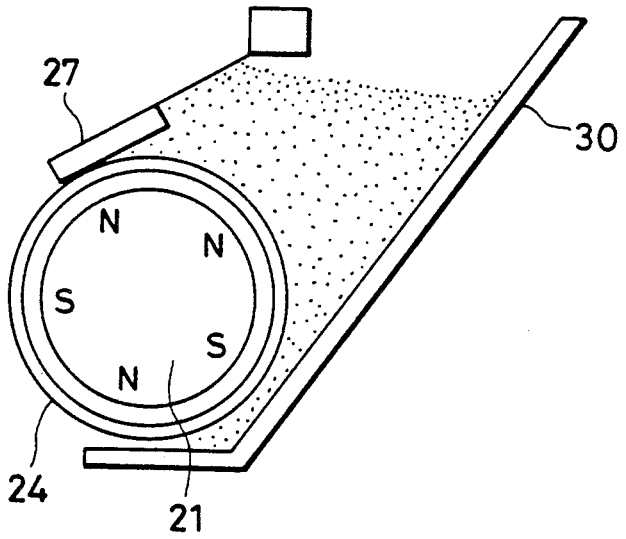
FIG. 3 is a schematic diagram of an example of a magnetic one-component developing system.

An additional test was carried out with a magnetic developer containing 2 parts by weight of carbon black and 40 parts by weight of magnetite in a styreneacrylic resin. This developer satisfied the equations $d_{75}/d_{25}=1.2$ and $d_{50}=11(\mu m)$. The developer was introduced into a magnetic developing system, as shown in FIG. 3, in which a magnet is incorporated into a developer sleeve 24. A uniform developer layer and a good copy picture were obtained.

As a comparative example, a developer of the same compound as described above, but satisfying the equations $d_{75}/d_{25}=2.0$ and $d_{50}=11(\mu m)$, was tested by the use of the same developing system. In this test, the layer of the developer was not uniform and good copy pictures were not obtained.

According to the one-component developing system of the present invention, a developer having a particle diameter distribution satisfying the relation of the equation $d_{75}/d_{25} \leqq d_{50}/40+1.2$ is used. The expressions $d_{25}$, $d_{50}$ and $d_{75}$ represent particle diameters when percentage by volume or by weight per the total amount of the particles is 25%, 50% and 75%, respectively, when the developer particles are integrated in the order of increasing diameter. A uniform developer layer can be formed on a developer sleeve after being restricted by a restriction member. Accordingly, uniform and dark black images can be obtained consistently in the solid region, and fog is never produce in the background region.

Obviously, many modifications and variations of the invention are possible in light of the above. It is to be understood that such modifications and variations are intended to be within the scope of the appended claims.

What is claimed is:

1. In the method of operating an electrostatic image reproduction machine wherein particles of a monocomponent developer having particle diameters of 5–20 82 m are formed into a uniform layer on a developer sleeve means by being passed between said sleeve mean sand a restriction member maintained under pressure in contact with said sleeve means and wherein an electric charge is imparted to the developer particles on said sleeve means prior to transfer thereof onto an electrostatic latent image retained on an electrostatic latent image retainer spaced opposite said developer sleeve, the improvement wherein said developer particles have a particle size distribution satisfying the following expression $$D_{75}/d_{25} \leqq d_{50}/40+1.2$$

where $d_{25}$, $d_{50}$ and $d_{75}$ represent those particle diameters for which the integrated percentages, by weight or by volume, of particles of equal or lesser diameters constitute 25%, 50% and 75%, respectively, of the total amount of said developer particles, so that aid developer particles are enabled to consistently from a uniform thin layer on said sleeve means after being restricted by said restriction member.

2. The method of claim 1, wherein the developer is magnetic.

3. The method of claim 2, wherein the sleeve means includes a magnet.

4. The method of claim 1, wherein the developer is non-magnetic.

5. The method of claim 1, wherein the restriction member includes a spring member having a covering containing rubber.

6. The method of claim 5, also including vanadium pentoxide on the spring member.

7. The method of claim 4, wherein said developer includes a pigment and a polarity control agent dispersed in a thermoplastic resin.

8. The method of apparatus of claim 7, wherein the pigment includes carbon black and the polarity control agent includes auriferous dye.

9. The method of claim 7, wherein the pigment includes phthalocyanine blue pigment and the polarity control agent includes quaternary ammonium salt.

10. The method of claim 1, wherein the developer includes carbon black and magnetite dispersed in a styrene-acrylic resin.

* * * * *

UNITED STATES PATENT AND TRADEMARK OFFICE

CERTIFICATE OF CORRECTION

PATENT NO. : 5,063,133

DATED : November 05, 1991

INVENTOR(S) : Tsutomu KUBO et al.

It is certified that error appears in the above-identified patent and that said Letters Patent is hereby corrected as shown below:

Claim 1, column 5, line 40, change "82 m" to --μm--.
Claim 1, column 5, line 41, change "mean" to --means--.
Claim 1, column 5, line 42, change "sand" to --and--.
Claim 1, column 6, line 9, change "$D_{75}$" to --$d_{75}$--.
Claim 1, column 6, line 15, change "aid" to --said--.
Claim 1, column 6, line 16, change "from" to --form--.
Claim 8, column 6, line 34, Delete "apparatus of"

Signed and Sealed this

Eighth Day of June, 1993

*Attest:*

Michael K. Kirk

MICHAEL K. KIRK

*Attesting Officer*

*Acting Commissioner of Patents and Trademarks*